US009352896B2

(12) United States Patent
Deutsch

(10) Patent No.: US 9,352,896 B2
(45) Date of Patent: May 31, 2016

(54) DISPENSER APPARATUS

(71) Applicant: Berry Plastics Corporation, Evansville, IN (US)

(72) Inventor: Mark Deutsch, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/199,177

(22) Filed: Mar. 6, 2014

(65) Prior Publication Data

US 2014/0263741 A1 Sep. 18, 2014

Related U.S. Application Data

(60) Provisional application No. 61/781,434, filed on Mar. 14, 2013.

(51) Int. Cl.

| | |
|---|---|
| ***B65D 83/30*** | (2006.01) |
| ***B05B 15/04*** | (2006.01) |
| *B65D 83/20* | (2006.01) |

(52) U.S. Cl.

CPC ..... *B65D 83/303* (2013.01); *B05B 15/0406* (2013.01); *B65D 83/205* (2013.01)

(58) Field of Classification Search

CPC .. B05B 1/1645; B05B 15/04; B05B 15/0406; B65D 83/14; B65D 83/16; B65D 83/20; B65D 83/205; B65D 83/30; B65D 83/303; B65D 83/206; B65D 83/28

USPC ..... 239/103, 120–122, 337–339, 391, 392, 239/393, 437, 443–447, 587.2–587.5; 222/402.13, 402.17, 536

See application file for complete search history.

(56) References Cited

U.S. PATENT DOCUMENTS

| | | | | |
|---|---|---|---|---|
| 5,961,010 | A | 10/1999 | Smith | |
| 6,796,464 | B1 * | 9/2004 | Tung | 222/402.17 |
| D536,970 | S | 2/2007 | Shannan et al. | |
| 7,506,782 | B2 | 3/2009 | Walters et al. | |

* cited by examiner

*Primary Examiner* — Christopher Kim
(74) *Attorney, Agent, or Firm* — Barnes & Thornburg LLP

(57) ABSTRACT

A fluid-dispensing unit in accordance with the present disclosure includes a fluid-storage can, a fluid-discharge controller, and a discharge unit coupled to the fluid-discharge controller. The fluid-storage can includes a container formed to include a fluid reservoir and a fluid discharger coupled to the container to communicate with the fluid reservoir in the container and allow pressurized fluid to exit the fluid-storage can in response to engagement of an actuator of the fluid-discharge controller. The discharge unit is configured to direct the exiting fluid through a spray path in response to engagement of the actuator.

10 Claims, 7 Drawing Sheets

DISPENSER APPARATUS

PRIORITY CLAIM

This application claims priority under 35 U.S.C. §119(e) to U.S. Provisional Application Ser. No. 61/781,434, filed Mar. 14, 2013, which is expressly incorporated by reference herein.

BACKGROUND

The present disclosure relates to a dispensing closure for a container in which a dispensable fluid is stored, and particularly to a trigger-actuated dispensing closure. More particularly, the present disclosure relates to a dispensing closure for a container that includes a straw for dispensing fluid.

SUMMARY

A fluid-dispensing unit in accordance with the present disclosure includes a fluid-storage can, a fluid-discharge controller, and a discharge unit coupled to the fluid-discharge controller. The fluid-storage can includes a container formed to include a fluid reservoir and a fluid discharger coupled to the container to communicate with the fluid reservoir in the container and allow pressurized fluid to exit the fluid-storage can in response to engagement of an actuator of the fluid-discharge controller. The discharge unit is configured to direct the exiting fluid through a spray path in response to engagement of the actuator.

In illustrative embodiments, a fluid-dispensing unit in accordance with the present disclosure includes a fluid-storage can, a fluid-discharge controller, and a dual-discharge unit coupled to the fluid-discharge controller. The fluid-storage can includes a container formed to include a fluid reservoir and a fluid discharger coupled to the container to communicate with the fluid reservoir in the container and allow pressurized fluid to exit the fluid-storage can in response to engagement of an actuator of the fluid-discharge controller. The dual-discharge unit is configured to direct such exiting fluid through either spray path or a straw path, depending on the pivoting orientation of the dual-discharge unit with respect to the fluid-discharge controller.

In illustrative embodiments, the fluid-discharge controller includes a hood. The hood is arranged to extend above and around the dual-discharge unit to provide protection to the dual-discharge unit against unintended damage from external forces.

In illustrative embodiments, the fluid-discharge controller includes a drip unit. The drip unit is arranged to extend radially inward of and below the dual-discharge unit and provides a flow path for fluid that may unintentionally leak out before it travels through the dual-discharge unit.

In illustrative embodiments, the fluid-discharge controller includes a straw retainer. The straw retainer is configured to retain a straw of the dual-discharge unit when the dual-discharge unit is configured to direct exiting fluid through the straw path.

In illustrative embodiments, the fluid-discharge controller includes one or more gripping ribs. The gripping ribs are configured to extend along a side wall of the fluid-discharge controller to provide a gripping surface for a user's fingers when using the fluid-dispensing unit.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION OF THE DRAWINGS

Figure 1:
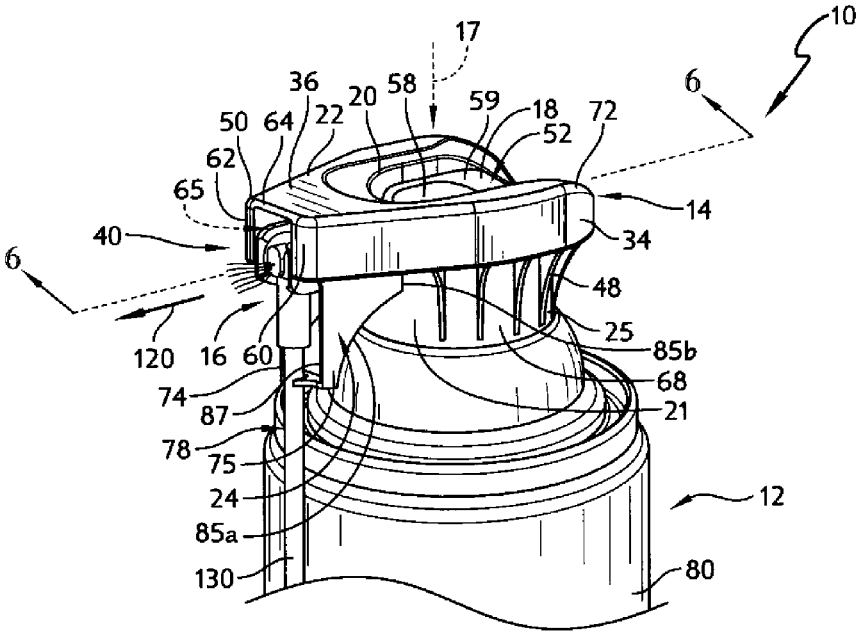
FIG. 1 is a front perspective view of a first embodiment of a fluid-dispensing unit showing that the fluid-dispensing unit includes a fluid-storage can, a fluid-discharge controller in accordance with the present disclosure coupled to the fluid-storage can, and a dual-discharge unit coupled to the fluid-discharge controller in which the dual-discharge unit is in a first position to direct the flow of pressurized fluid stored in the fluid-storage can through a spray path.
Figure 2:
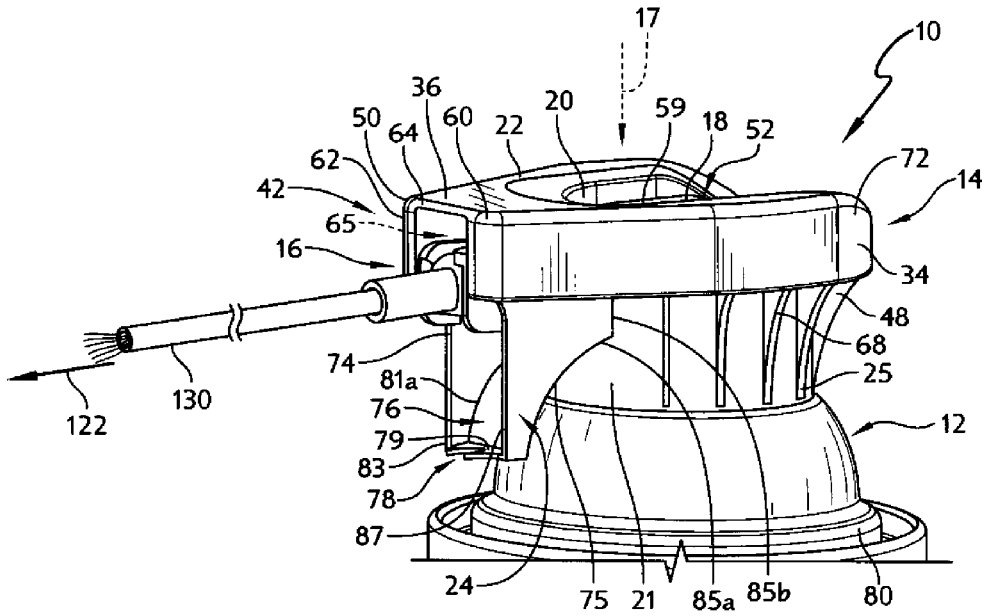
FIG. 2 is a front perspective view of a fluid-dispensing unit of FIG. 1 showing a straw included in the dual-discharge unit has been rotated upward about ninety degrees to move the dual-discharge unit to a second in which the flow of pressurized fluid stored in the fluid-storage can is directed through a straw path.
Figure 3:
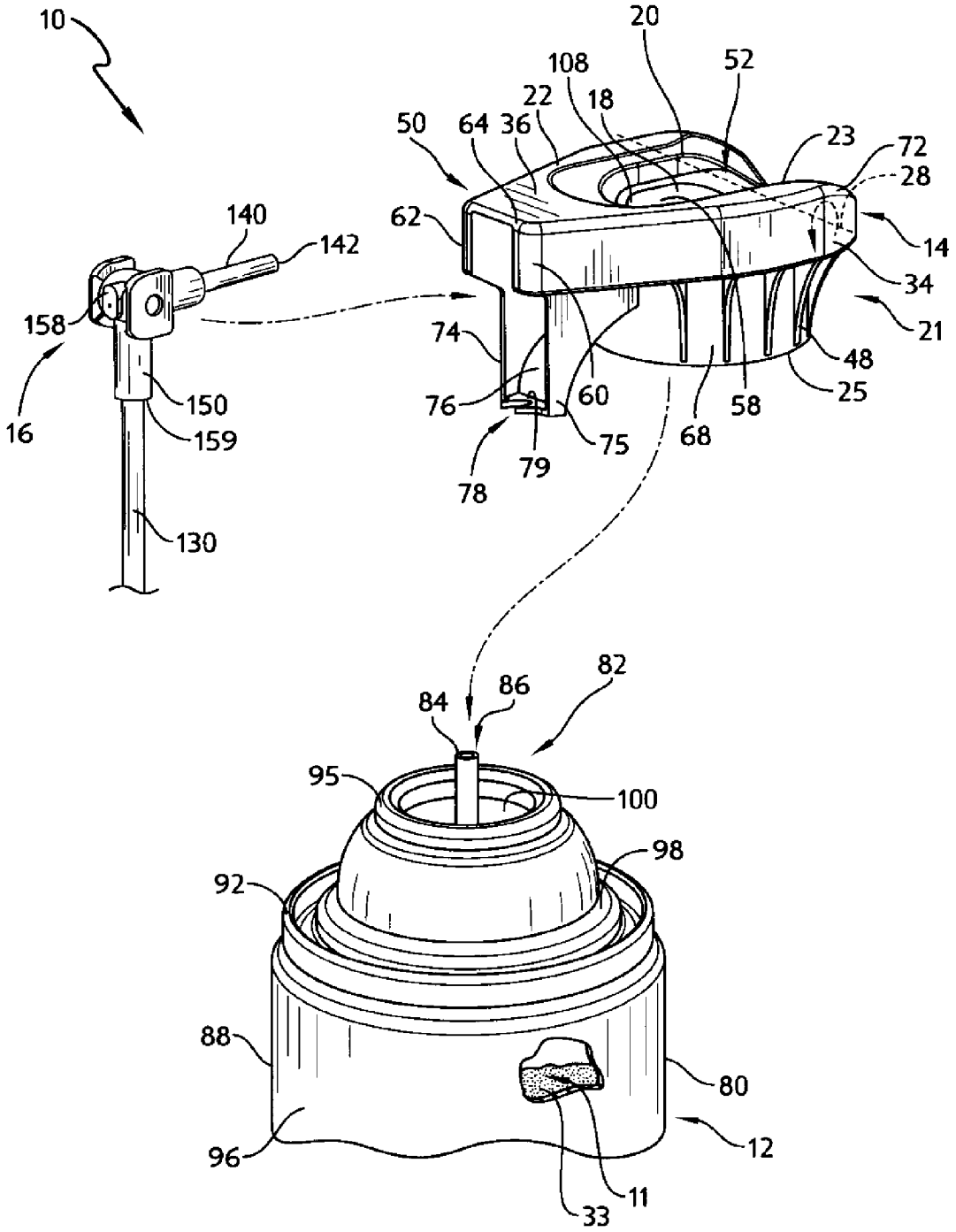
FIG. 3 is an exploded unit view of the fluid-dispensing unit of FIGS. 1 and 2 showing that the fluid-dispensing unit includes, from top-left to bottom-right, the dual-discharge unit that includes a discharge connector, a swivel knuckle, and a straw coupled to the swivel knuckle, a fluid-discharge controller including a trigger and a can lid formed to include an actuator aperture through which the trigger extends, and a fluid-storage can including a fluid discharger and a container formed to include a fluid reservoir.

A fluid-dispensing unit 10 in accordance with the present disclosure includes a fluid-storage can 12, a fluid-discharge controller 14, and a dual-discharge unit 16 as shown, for example, in FIGS. 1-3. Fluid-discharge controller 14 is coupled to fluid-storage can 12 and is configured to control the discharge of pressurized fluid stored in a fluid reservoir 11 in fluid-storage can 12.

Fluid-discharge controller 14 includes an actuator 52 that allows for discharge of the pressurized fluid through a discharge orifice 29 when the actuator 52 is actuated by a user. Dual-discharge unit 16, sometimes called a two-way spray unit, may be coupled to discharge orifice 29 to direct the flow of pressurized fluid through either a spray path 120 or a straw path 122 in the dual-discharge unit 16. Spray path 120 may be used when dual-discharge unit 16 is in a first position 40, as illustrated in FIG. 1, and straw path 122 may be used when dual-discharge unit 16 is in a second position 42, as illustrated in FIG. 2.

Figure 4:
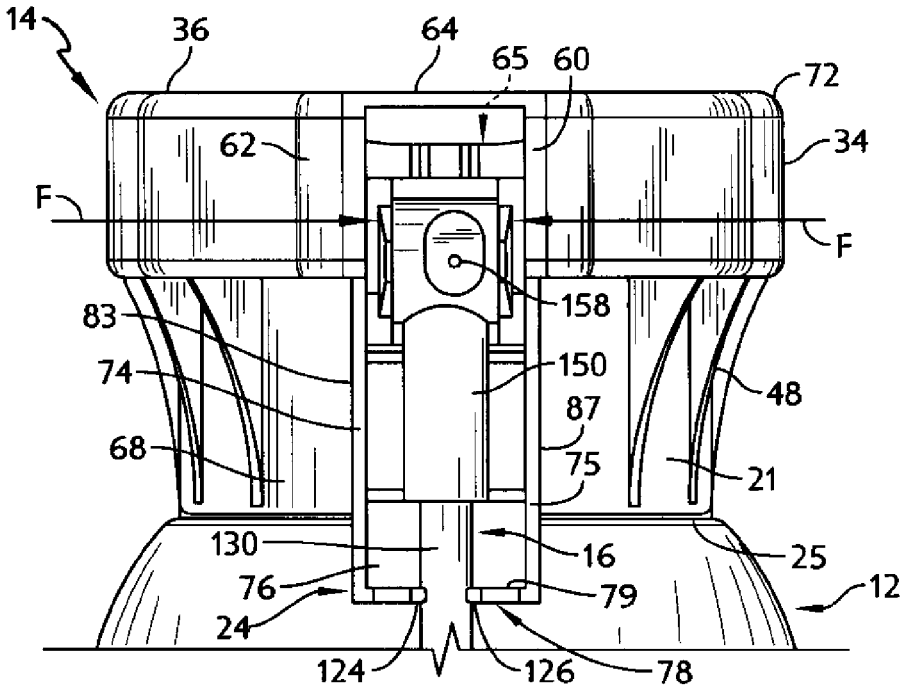
FIG. 4 is a front elevation view of the fluid-discharge controller and dual-discharge unit of FIG. 1 showing that the dual-discharge controller fits within a recess aperture formed in the fluid-discharge controller and that the fluid-discharge controller includes a straw retainer for retaining the straw and hand grips or gripping ribs along a side of the can lid for a user to grip when using the fluid-dispensing unit.

Fluid-discharge controller 14 includes a can lid 22 that provides complimentary features to dual-discharge unit 16 and for use of fluid-dispensing unit 10. A hood 50 extends above and substantially around dual-discharge unit 16 to provide protection to dual-discharge unit 16 against unintended damage from external forces F as illustrated in FIG. 4. A drip unit 24 extends radially inward of and below dual-discharge unit 16. Drip unit 24 provides a flow path for fluid that may unintentionally leak out of discharge orifice 29 or dual-discharge unit 16 as illustrated in FIGS. 3 and 6. A straw retainer 78, sometimes called a straw support, is configured to retain a straw 130 of dual-discharge unit 16 when dual-discharge unit 16 is in second position 42 as illustrated in FIG. 1. One or more gripping ribs 48 are configured to extend along a side wall 68 of the can lid 22 to provide a gripping surface for a user's fingers when using fluid-dispensing unit 10.

Fluid-discharge controller 14 illustratively includes can lid 22 and actuator 52 as shown in FIG. 3. Can lid 22 is mounted on fluid-storage can 12 to define a shell space 15 between can lid 22 and fluid-storage can 12 as shown, for example, in FIGS. 6A and 6B. Actuator 52 is coupled to can lid 22 and arranged to extend through an actuator aperture 20 formed in a top platform 72 of can lid 22. Actuator 52 is coupled to can lid 22 to move relative to can lid 22 between a discharge-blocking position that prevents flow of pressurized flow from fluid reservoir 11 and a discharge-allowing position that allows flow of pressurized fluid from fluid reservoir 11. Actuator 52 moves in a downward direction 17 from the discharge-blocking position to the discharge-allowing position.

Can lid 22 of fluid-discharge controller 14 includes a shell 21, a trigger mount 23, and a drip unit 24 as illustrated in FIGS. 1, 2, 3 and 6. Shell 21 is coupled to fluid-storage can 12 by a shell rim 25 as shown in FIGS. 1 and 2. Shell 21 extends upwardly away from fluid-storage can 12. Trigger mount 23 is appended to an inner surface of shell 21 that defines actuator aperture 20 in top platform 72 of can lid 22 as shown in FIG. 3. Actuator 52 is coupled to trigger mount 23 to move relative to trigger mount 23 through actuator aperture 20 along trigger axis 28.

Shell 21 includes a shell side wall 68, shell top platform 72, and hood 50 as illustrated in FIGS. 1 and 2. Shell side wall 68 includes shell rim 25 that couples can lid 22 to fluid-storage can 12. Shell top platform 72 is formed to include actuator aperture 20 that is arranged to open into shell space 15 as shown, for example, in FIGS. 6A and 6B. Shell top platform 72 also includes a platform side wall 34 and a platform top wall 36 as illustrated in FIGS. 1 and 2. Platform side wall 34 extends radially outward from shell side wall 68. Platform top wall 36 extends radially inward of platform side wall 34 and is substantially perpendicular to platform side wall 34. Actuator aperture 20 is formed within platform top wall 36.

Figure 5:
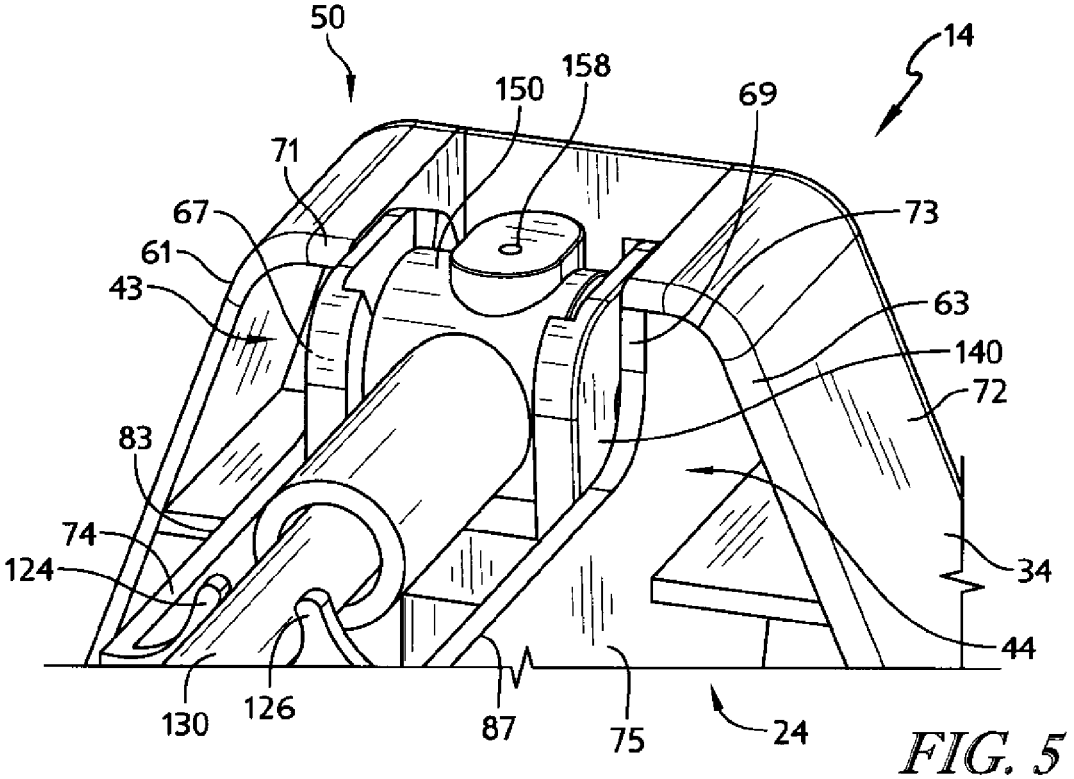
FIG. 5 is a partial perspective view of the fluid-discharge controller and dual-discharge unit of FIG. 4 with portions broken away to reveal the dual-discharge controller is protected by a hood that extends from a top platform of the fluid-discharge controller and surrounds dual-discharge controller, and also showing the hood includes shock gaps or spacing to provide a shock-absorbing feature to protect the dual-discharge controller.

As illustrated in FIGS. 4 and 5, hood 50 includes a left guard 62, a right guard 60, and a top guard 64 coupled to both left guard 62 and right guard 60. As illustrated in FIG. 1, top guard 64 is coupled to and coextensive with platform top wall 36 of top platform 72. Similarly, left guard 62 and right guard 60 are coupled to and coextensive with platform side wall 34 and are configured to define ends of platform side wall 34. Left guard 62 and right guard 60 are spaced apart from each other. Left guard 62, right guard 60, and top guard 64 are coupled together to form a discharge-receiving aperture 65 therebetween as illustrated in FIG. 4.

Discharge-receiving aperture 65 is configured to receive a portion of dual-discharge unit 16 when dual-discharge unit 16 is coupled to fluid-discharge controller 14. In illustrative embodiments, left guard 62, right guard 60, and top guard 64 are configured to extend substantially around a portion of dual-discharge unit 16 when it is located within discharge-receiving aperture 65. In this way, hood 50 protects dual-discharge unit 16 from direct impact from external forces F that may be applied near hood 50, such as from accidental or unintentional dropping during manufacturing, transport, or use of fluid-dispensing unit 10.

Left guard 62 includes a first guard panel 61, a second guard panel 67, and a front guard panel 71 as illustrated in FIG. 5. First guard panel 61 is coupled to and coextensive with platform side wall 34. Second guard panel 67 is spaced apart from first guard panel 61 such that second guard panel 67 is located between first guard panel 61 and discharge-receiving aperture 65. In illustrative embodiments, second guard panel 67 defines discharge-receiving aperture 65. In further illustrative embodiments, second guard panel 67 may be in close proximity to or abut against dual-discharge unit 16 when dual-discharge unit 16 is located in discharge-receiving aperture 65.

Right guard 60 includes a first guard panel 63, a second guard panel 69, and a front guard panel 73 as illustrated in FIG. 5. First guard panel 63 is coupled to and coextensive with platform side wall 34. Second guard panel 69 is spaced apart from first guard panel 63 such that second guard panel 69 is located between first guard panel 63 and discharge-receiving aperture 65. In illustrative embodiments, second guard panel 69 defines discharge-receiving aperture 65. In further illustrative embodiments, second guard panel 69 may be in close proximity to or abut against dual-discharge unit 16 when dual-discharge unit 16 is located in discharge-receiving aperture 65.

Right guard 60 and left guard 62 are configured to be substantially mirror images of each other as they surround discharge-receiving aperture 65. In illustrative embodiments, front guard panels 71, 73 may extend from first guard panels 61, 63 to second guard panels 67, 69, respectively. First guard panel 61, front guard panel 71, and second guard panel 67 are configured to be coupled together to form left shock-absorbing gap 43 as illustrated in FIG. 5.

First guard panel 63, front guard panel 73, and second guard panel 69 are configured to be coupled together to form right shock-absorbing gap 44. Left and right shock-absorbing gaps 43 and 44 are configured to provide additional protection to dual-discharge unit 16 from unintentional external forces F. If an external force F is large enough to cause movement of first guard panels 61, 63, this movement can occur into left and right shock-absorbing gaps 43 and 44 without affecting the shape or volume of discharge-receiving aperture 65.

As illustrated in FIGS. 1, 2 and 6, drip unit 24 is located below top platform 72 of can lid 22 and extends downwardly from top platform 72 toward fluid-storage can 12. In illustrative embodiments, drip unit 24 may be coupled to shell side wall 68. Drip unit 24 includes left and right side supports 74, 75, a drip shield 76, and a straw retainer 78 as illustrated in FIG. 4. Left and right side supports 74, 75 are spaced apart from each other, extend downwardly from top platform 72, and are configured to be substantially perpendicular to top platform 72.

Figure 6A:
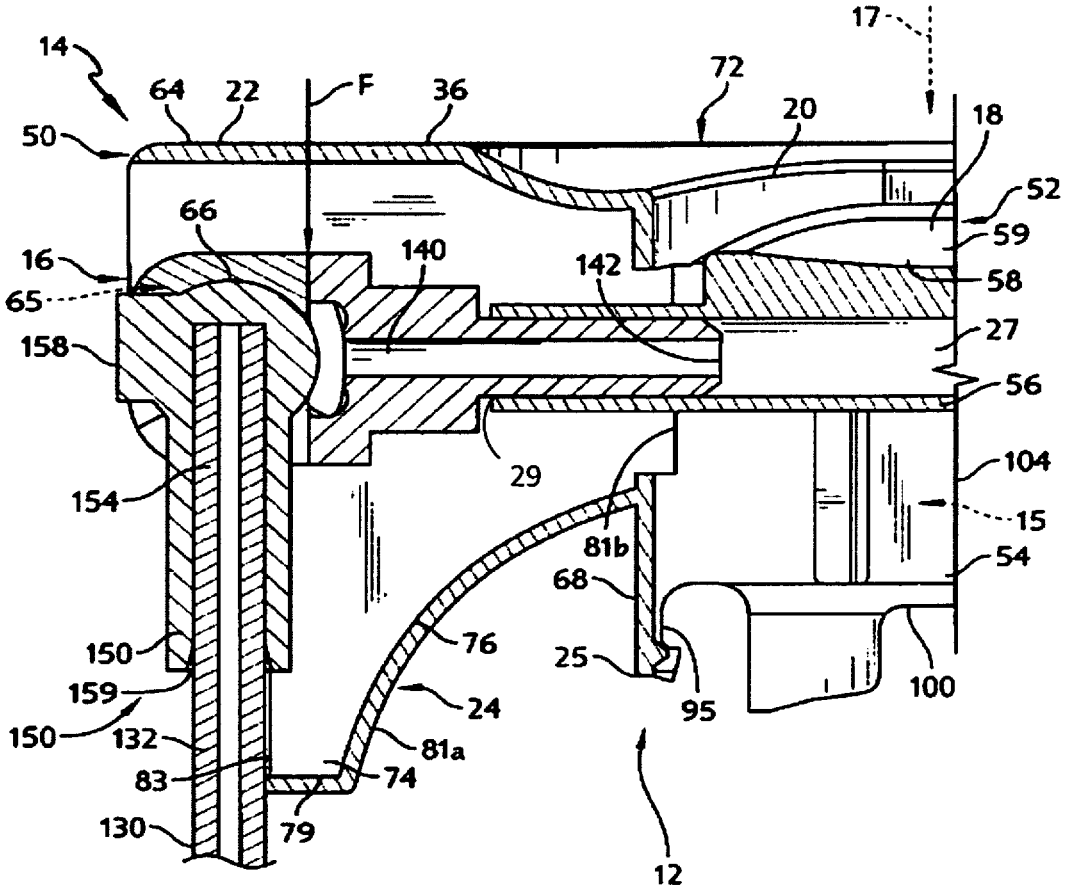
FIG. 6A is a sectional view taken along line 6A-6A of FIG. 1 showing that the dual discharge unit is coupled to a discharge orifice of the actuator of the fluid-discharge controller and showing that the dual-discharge unit is in the first position which allows flow of pressurized liquid through a spray channel in the dual-discharge unit that corresponds with the spray path, the spray channel being substantially perpendicular to and non-intersecting to a straw channel in the dual-discharge unit that corresponds with the straw path.

Left side support 74 includes a curved back edge 81*a*, a straight back edge 81*b* coupled to curved back edge 81*a*, and a straight front edge 83 as illustrated in FIGS. 2 and 6A. Similarly, right side support 75 includes a curved back edge 85*a*, a straight back edge 85*b* coupled to curved back edge 85*a*, and a straight front edge 87 as illustrated in FIGS. 1 and 2. Left and right side supports 74 and 75 are mirror images of each other. Curved back edge 81*a* of left side support 74 couples to drip shield 76. Curved back edge 85*a* of right side support 75 is spaced apart from curved back edge 81 and also couples to drip shield 76. Straight back edges 81*b* and 85*b* are coupled to shell side wall 68.

Drip shield 76 extends between left and right side supports 74, 75 at substantially a right angle to left and right side supports 74, 75. In illustrative embodiments, drip shield 76 may be shaped as an arc or a curve shaped similar to curved back edges 81*a* and 85*a*. Drip shield 76 extends from the point where curved back edge 81*a* couples to straight back edge 81*b* and curved back edge 85*a* couples to straight back edge 85*b*. Drip shield 76 may extend from this point to a point radially outward of fluid-dispensing unit 10.

As a result, drip shield 76 creates a ramp or slope for fluid to flow down if fluid is unintentionally discharged from fluid-dispensing unit 10 before it reaches dual-discharge unit 16. Drip shield 76 blocks such unintentionally-discharged fluid form pooling in a brim 92 of fluid-storage can 12 when brim 92 is located below drip shield 76. Instead, fluid exits drip shield 76 along a lower edge 79 of drip shield that extends between left and right side supports 74, 75. Lower edge 79 is substantially perpendicular to straight front edges 83 and 87 of left and right sides supports 74, 75 and defines the end of drip shield 76.

Straw retainer 78 is coupled to lower edge 79 of drip shield 76 and includes a left retention nub 124 and a right retention nub 126 as illustrated in FIGS. 4-5. Left and right retention nubs 124, 126 are configured to mate with a straw 130 used in straw path 122 of dual-discharge unit 16 when dual-discharge unit 16 is in second position 42 as illustrated in FIG. 2. In illustrative embodiments, left and right retention nubs 124, 126 are configured to be in frictional engagement with straw 130, securing straw 130 in a fixed position that is substantially parallel and adjacent to fluid-storage can 12 when in second position 42.

In illustrative embodiments, shell side wall 68 of can lid 22 may include one or more gripping ribs 48 that extend radially outward from shell side wall 68. Gripping ribs 48 may be spaced apart from each other about the circumference of side wall 68 extend radially outward from side wall 68 from parallel axes along side wall 68. Gripping ribs 48 may include a curved outer surface that is conducive to the shape of a user's finger when the user grips shell side wall 68 to utilize fluid-dispensing unit 10. In this way, gripping ribs 48 provide a contoured feature around the periphery of shell side wall 68 to allow a user to retain a grip on the can lid 22 during dispensing of pressurized fluid 33 from fluid-dispensing unit 10.

Figure 6B:
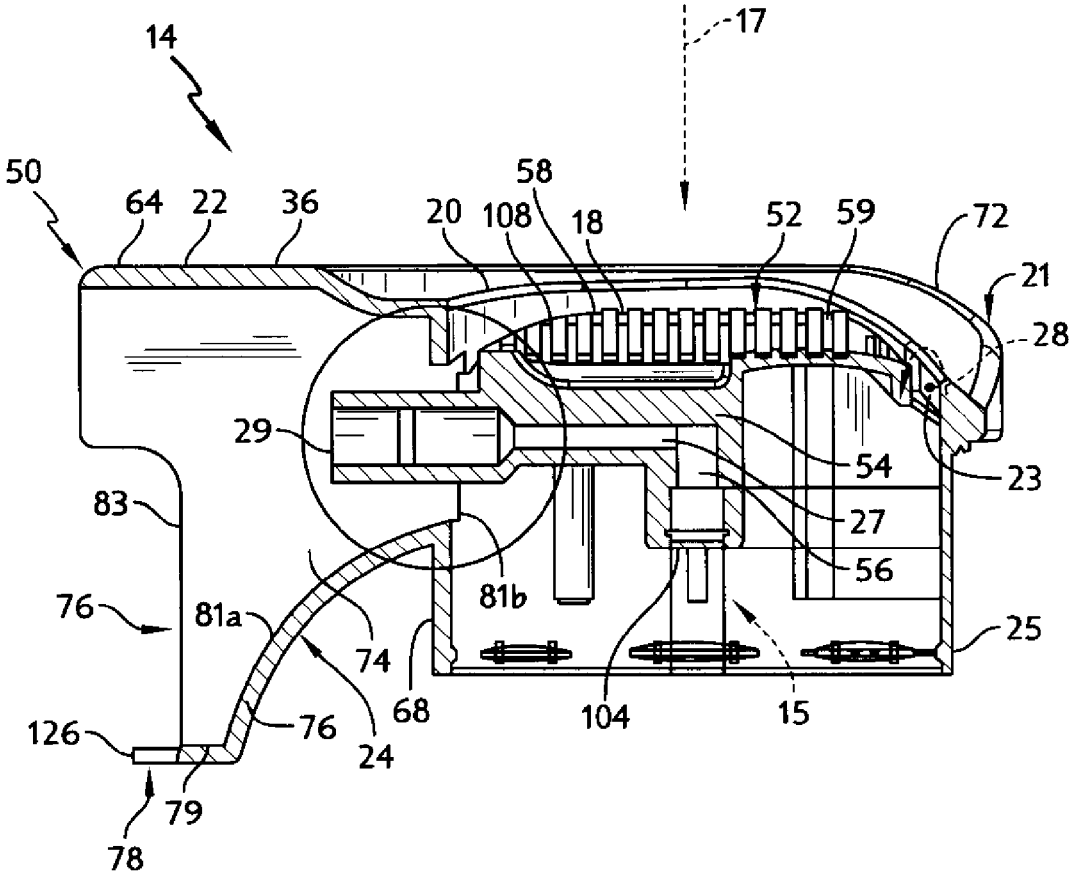
FIG. 6B is a view similar to FIG. 6A showing that the fluid-discharge controller includes a nozzle and a tube engagement orifice to allow fluid communication from the fluid-storage can to the actuator of the fluid-discharge controller.

Actuator 52 includes a trigger 18 and a trigger base 54 as shown, for example, in FIGS. 6A and 6B. Trigger base 54 is coupled to can lid 22 to move back and forth between the discharge-blocking position and the discharge-allowing position. Trigger 18 is appended to trigger base 54 to move therewith. In use, a finger of the user engages trigger 18 and applies user-applied force 19 to trigger 18 to cause trigger 18 to move in downward direction 17 from the discharge-blocking position to the discharge-allowing position. Trigger 18 is arranged to extend through actuator aperture 20 so that trigger 18 may be engaged by the user to cause pressurized fluid 33 to flow from fluid-storage can 12 through trigger base 54, out of discharge orifice 29 and through dual-discharge unit 16 when actuator 52 is in the discharge-allowing position.

Figure 7:
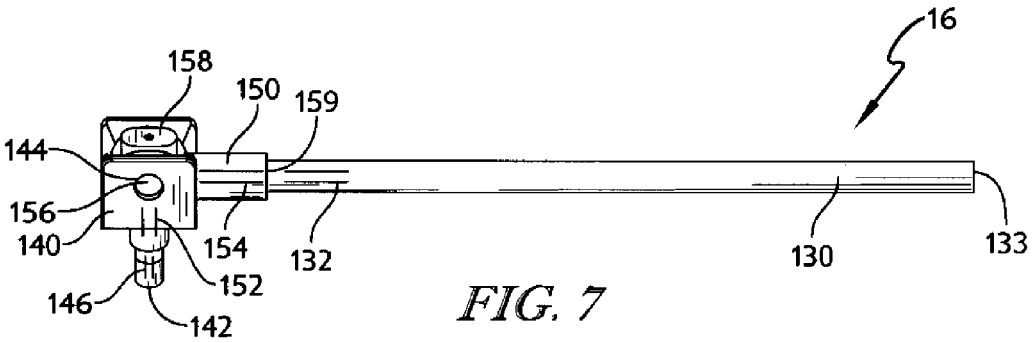
FIG. 7 is a perspective view of the dual-discharge unit of FIGS. 1 and 3, showing that the swivel knuckle is connected to the discharge connector by knuckle tabs that connect to associated knuckle tab receivers included in the discharge connector and showing that the straw is coupled to the swivel knuckle to be about ninety degrees to the discharge connector and including a straw orifice that allows fluid to flow out of the straw.
Figure 8:
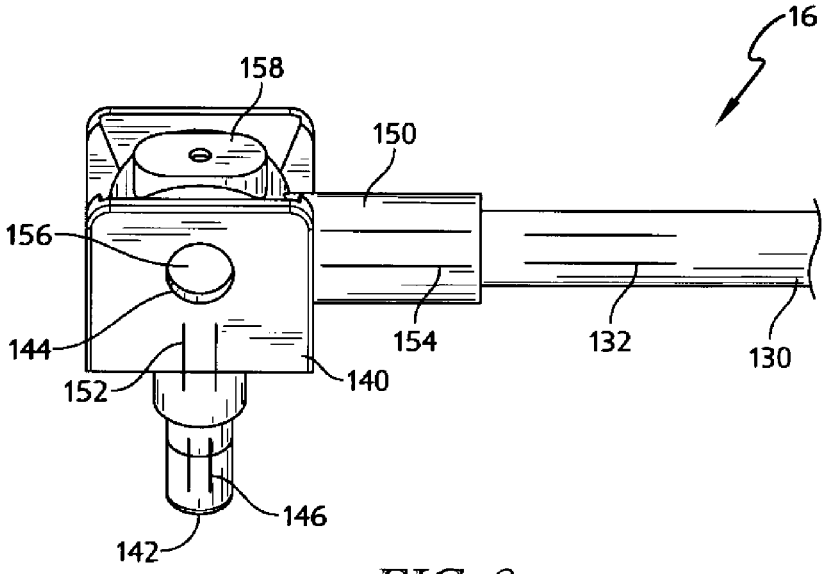
FIG. 8 is an enlarged perspective view of the dual-discharge unit of FIG. 7 showing that the dual-discharge unit includes a spray orifice that allows fluid to flow out of the dual-discharge unit is in the first position.

Dual-discharge unit 16 includes a discharge connector 140, a swivel knuckle 150, and straw 130 as illustrated in FIGS. 7 and 8. Discharge connector 140 is configured to be coupled to discharge orifice 29 of trigger 18 to provide a conduit for pressurized fluid 33 to flow through. Swivel knuckle 150 is pivotably coupled to discharge connector 140 to pivot 90 degrees to rotate dual-discharge unit from first position 40 to second position 42. Straw 130 is configured to secure to swivel knuckle 150 and is formed to include a straw passageway 132 through which pressurized fluid 33 can flow when dual-discharge unit 16 is in second position 42.

Discharge connector 140 includes a connection port 142 and a knuckle tab receiver 144 as illustrated in FIG. 8. Connection port 142 is configured to couple discharge connector 140 to discharge orifice 29 of trigger 18. Knuckle tab receiver 144 is configured to receive knuckle tabs 156 of swivel knuckle 150 to pivotable connect swivel knuckle 150 to discharge connector 140. Discharge connector 140 also include a flow passageway 146 to allow pressurized fluid 33 to flow through discharge connector 140 to swivel knuckle 150.

In illustrative embodiments, swivel knuckle 150 is formed to include a spray passageway 152 and a straw passageway 154. Spray passageway 152 and straw passageway 154 extend through swivel knuckle 150 but are substantially perpendicular to each other and do not intersect with each other.

When dual-discharge unit 16 is in first position 40, spray passageway 152 is aligned with and in fluid communication with flow passageway 146 of discharge connector 140 to allow pressurized fluid 33 to flow from flow passageway 146 and through spray passageway 152. A spray discharge 158 is located at the end of spray passageway 152 opposite of flow passageway 146 when dual-discharge unit 16 is in first position 40. When pressurized fluid 33 flows through spray passageway 152, it exits through spray discharge 158 and is released into the surrounding atmosphere for spray application of pressurized fluid 33. When dual-discharge unit 16 is in first position 40, spray passageway 152 makes up spray path 120.

When dual-discharge unit 16 is in second position 42, straw passageway 154 is aligned with and in fluid communication with flow passageway of discharge connector 140 to allow pressurized fluid 33 to flow from flow passageway 146 and through straw passageway 154. A straw discharge 159 is located at the end of straw passageway 154 opposite of flow passageway 146 when dual-discharge unit 16 is in second position 42. Straw discharge 159 is coupled to straw 130. When pressurized fluid 33 flows through straw passageway 154, it exits through straw discharge 159 and into straw passageway 132 of straw 130. Straw 130 includes a straw exit port 133 that is located at the end of straw passageway 132 of straw 130. Pressurized fluid 33 travels through straw passageway 132 of straw 130 and exits into the surrounding atmosphere through straw exit port 133 when straw passageway 154 of swivel knuckle 150 is aligned with straw passageway 132 of straw 130 when dual-discharge unit 16 is in second position 42. When dual-discharge unit 16 is in second position 42, straw passageway 154 and straw passageway 132 make up straw path 122.

Trigger 18 includes a grip 58 and a nozzle 56 as illustrated, for example, in FIGS. 6A and 6B. Nozzle 56 is coupled to trigger base 54 to connect trigger base 54 and trigger 18 for simultaneous activation. Grip 58 is configured to be gripped by a user to actuate trigger 18. Grip 58 may also include a plurality of ribs 108 appended to a top surface 59 of trigger 18. As an example, each rib 108 may be spaced apart from every other rib and arranged to extend across top surface 59. In one exemplary embodiment, ribs 108 may be circular in shape, with ribs 108 being inside one or more other ribs 108.

Fluid-storage can 12 includes a container 80 and a fluid discharger 82 as shown in FIG. 3. Fluid discharger 82 is coupled to container 80 and configured to allow the discharge of pressurized fluid 33 out of fluid reservoir 11 formed in container 80. Fluid discharger 82, for example, includes a movable outlet tube 84 and a discharge valve 86, as illustrated, for example, in FIG. 3. Movable outlet tube 84 is coupled to container 80 and is movable into container 80 when downward force is transferred to outlet tube 84 by trigger base 54 during engagement of trigger 18 by the user. The downward force is applied to outlet tube 84 toward container 80. Discharge valve 86 is coupled to outlet tube 84 to allow discharge of pressurized fluid 33 when outlet tube 84 is moved downward.

Container 80 of fluid-storage can 12 includes a body 88, a container brim 92, and a lid brim 95. Body 88 defines fluid reservoir 11 in which pressurized fluid 33 is stored. Body 88 includes a floor (not shown), a side wall 96, a tapered side wall 98, and a top wall 100 as illustrated in FIG. 3. Container brim 92 is coupled to side wall 96. Tapered side wall 98 extends upwardly from container brim 92 toward can lid 22 and couples to lid brim 95. Lid brim 95 is configured for mating engagement with shell rim 25 of can lid 22, as shown in FIGS. 1 and 2. Lid brim 95 couples to top wall 100. Movable outlet tube 84 of fluid discharger 82 is coupled to top wall 100.

Trigger 18 is coupled to outlet tube 84 of fluid discharger 82 by trigger base 54. Trigger base 54 of actuator 52 is formed to include a fluid conduit 27 and a tube engagement orifice 104 as shown in FIGS. 6A and 6B. When a user presses trigger 18 to move actuator 52 to the discharge-allowing position, trigger 18 pivots about a trigger axis 28 at trigger mount 23, causing trigger base 54 to rotate relative to can lid 22 as illustrated in FIG. 3. Trigger base 54 rotates about trigger axis 28 toward outlet tube 84 and engages with outlet tube 84 to release pressurized fluid 33 from fluid reservoir 11.

Downward movement of trigger base 54 allows tube engagement orifice 104 to move downward toward top wall 100 of container 80. Tube engagement orifice 104 is configured to receive movable outlet tube 84 therein to cause movable outlet tube 84 to move with trigger base 54. Fluid conduit 27 is coupled to tube engagement orifice 104 and discharge orifice 29 to provide a path of travel for pressurized fluid 33 to travel out from fluid reservoir 11, through movable outlet tube 84, through fluid conduit 27, and into discharge orifice 29. From there, pressurized fluid 33 travels into dual-discharge unit 16 and exits through either spray path 120 if dual-discharge unit 16 is in the first position 40 or straw path 122 if dual-discharge unit 16 is in the second position 42. If dual-discharge unit 16 is between the first position 40 and the second position 42, pressurized fluid 33 abuts against an outer wall 66 of swivel knuckle 150 and is blocked from further movement.

In illustrative embodiments, a fluid-dispensing unit 10 includes a fluid-storage can 12, a fluid-discharge controller 14, and a two-way spray unit 16. Fluid-discharge controller 14 includes an integrated hood 50 that protects two-way spray unit 16 from damage when fluid-dispensing unit 10 is dropped during transport or manufacturing. Further, hood 50 may protect two-way spray unit 16 from force F that may be applied to fluid-discharge controller 14 in any direction during the manufacturing process or consumer use. Air gaps 43, 44 in hood 50 absorb the shock on impact or force application. An integrated straw support 78 is included in fluid-discharge controller 14 that retains a straw 130 in a 90 degree position 42 with respect to a can lid 22 of fluid-discharge controller 14. Straw support 78 may retain straw 130 during transport from cap supplier to filler and during the capping process. Without straw support 78, straw 130 may rotate to the spray position and clog the cap feeding or capping equipment. Integrated hand grips 48 on can lid 22 provide contoured features on both sides of the cap to allow the consumer to retain grip of the can lid 22 and fluid-dispensing unit 10 during dispensing of product. An integrated drip unit 24 coupled to fluid-discharge controller 14 captures and diverts product that may drip or leak from two-way spray unit 16 during spray away from the consumer's hand and away from the top of the storage can 12 where fluid can accumulate. In illustrative embodiments, drip unit 24 may be integrated as part of straw support 78 or vice versa.

Figure 9:
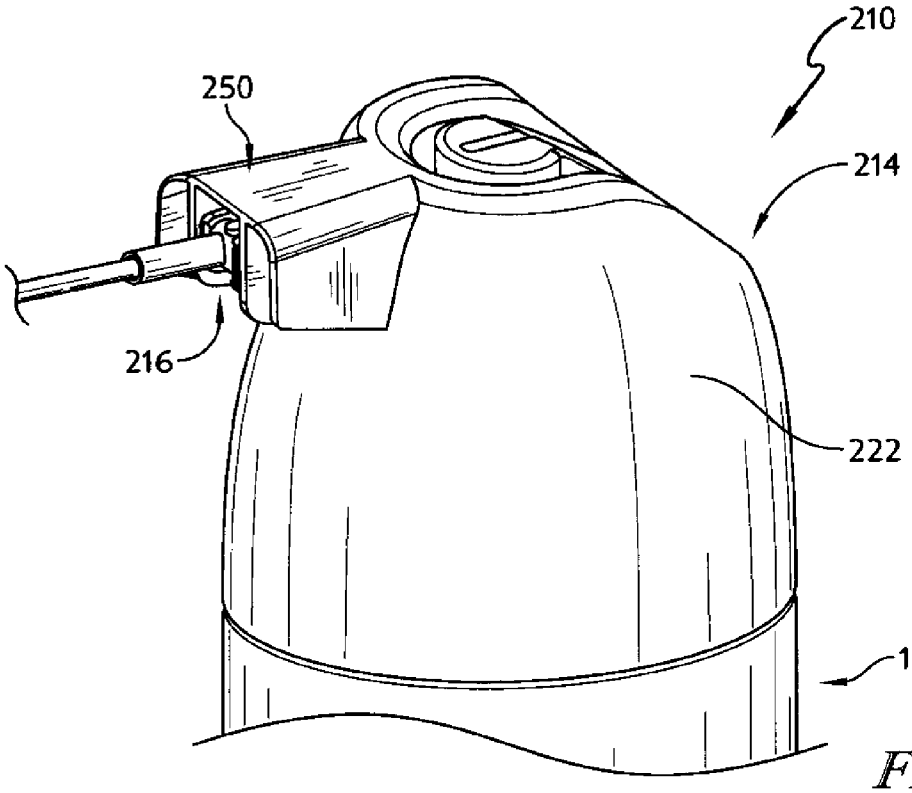
FIG. 9 is a front perspective view of another embodiment of a fluid-dispensing unit in accordance with the present disclosure showing that the fluid-dispensing unit includes a fluid-storage can, a fluid-discharge controller coupled to the fluid-storage can, and a dual-discharge unit coupled to the fluid-discharge controller in which the dual-discharge unit is in a second position to direct the flow of pressurized fluid stored in the fluid-storage can through a straw path.
Figure 10:
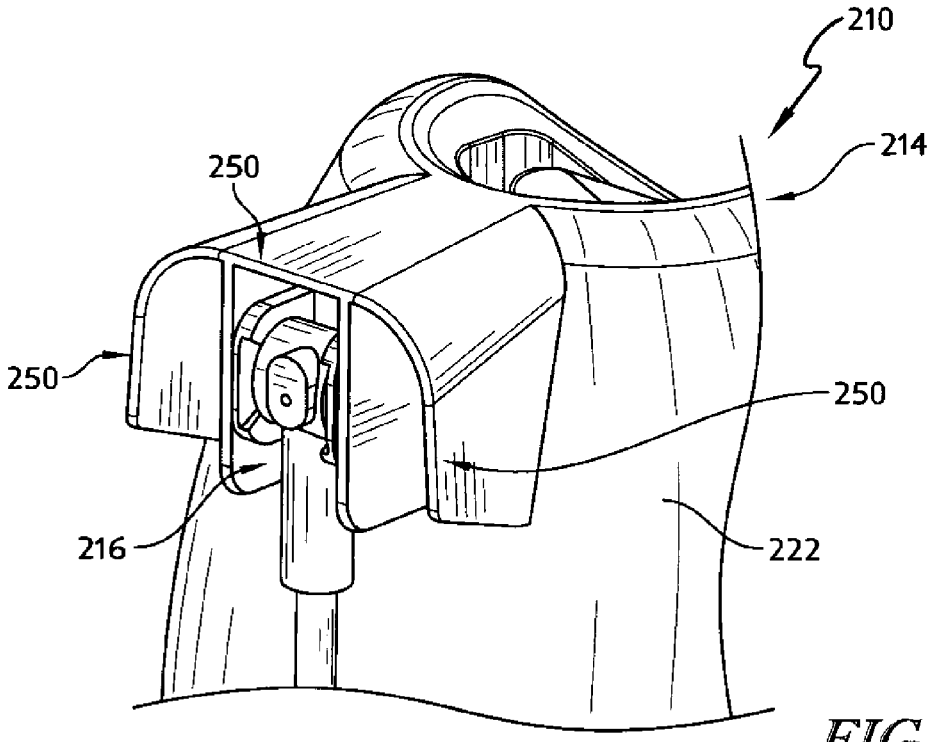
FIG. 10 is a front perspective view of the fluid-dispensing unit of FIG. 9 showing that a straw included the dual-discharge unit has been rotated downward about ninety degrees to move the dual-discharge unit to a first position such that the dual-discharge unit directs the flow of pressurized fluid stored in the fluid-storage can through a spray path.

A fluid-dispensing unit 210 in accordance with the present disclosure includes a fluid-storage can 12, a fluid-discharge controller 214, and a dual-discharge unit 216 as shown, for example, in FIGS. 9 and 10. Fluid-discharge controller 214 is coupled to fluid-storage can 12 and is configured to control the discharge of pressurized fluid stored in a fluid reservoir 11 in fluid-storage can 12.

Fluid-discharge controller 214 includes an actuator 52 that allows for discharge of the pressurized fluid through a discharge orifice 29 when the actuator 52 is actuated by a user. Dual-discharge unit 216 may be coupled to discharge orifice to direct the flow of pressurized fluid through either a spray path or a straw path in the dual-discharge unit 216. Spray path may be used when dual-discharge unit 216 is in a first position as illustrated in FIG. 9 and straw path may be used when dual-discharge unit 216 is in a second position as illustrated in FIG. 10.

Fluid-discharge controller 214 includes a can lid 222 that provides complimentary features to dual-discharge unit 216 and for use of fluid-dispensing unit 210. A hood 250 extends above and substantially around dual-discharge unit 216 to provide protection to dual-discharge unit 216 against unintended damage from external forces F.

The present disclosure includes an injection molded, two-way spray-through overcap. The two-way spray-through overcap incorporates a hooded device into a spray-through overcap allowing product to spray as a spray and by raising the snorkel/spray as a stream. Assembly of the disclosed overcap allows flexibility for a customer using the overcap.

In the illustrative embodiment, an integrated hood protects the two-way spray assembly from damage when dropped, during transport, and during manufacturing. The integrated hood prevents damage to the spray/knuckle assembly by providing an air gap between the knuckle assembly and the exterior of the structure. The hood structure absorbs both static and impact forces that may be applied through manufacturing, shipping, and end use.

In the illustrative embodiment, an integrated straw support retains the straw in the 90 degree position during transport from cap supplier to filler and during the capping process. When not retained by the straw support, an extended straw could jam the assembly in an assembly machine or capper on the filling line.

In the illustrative embodiment, an integrated drip shield captures and diverts product that may drip during spray away from a consumer's hand and away from the top of the can. The integrated drip shield prevents consumer contact with package contents that could potentially leak from clearance in the knuckle assembly or residual product build up from the spray orifice by providing a flow channel to direct the product away from the end user's hand.

In the illustrative embodiment, a set of integrated hand grips provide contoured features on both sides of the cap to allow a consumer to retain grip of the cap and can assembly during dispensing of a product. The illustrative integrated hand grips are added to the periphery of an inner shell to provide additional grip to a consumer using the overcap as part of a package to improve the customer experience.

The invention claimed is:

1. A fluid-dispensing unit comprising a fluid-storage can including a container formed to include a fluid reservoir and a fluid discharger coupled to the container to communicate with the fluid reservoir in the container and allow pressurized fluid to exit the fluid-storage can, a fluid-discharge controller including a can lid mounted on the fluid-storage can and an actuator coupled to the can lid to move relative to the can lid from a discharge-blocking position arranged to prevent flow of pressurized fluid from the fluid reservoir to a discharge-allowing position arranged to allow flow of pressurized fluid from the fluid reservoir, and a dual-discharge unit formed to include a spray path and a straw path, the dual-discharge unit coupled to the fluid-discharge controller to move relative to the fluid-discharge controller between a first position arranged to direct the allowed flow of pressurized fluid from the fluid discharger through the spray path and a second position arranged to direct the allowed flow of pressurized fluid from the fluid discharger through the straw path, wherein the can lid includes a shell formed to include a hood arranged to extend above and around the dual-discharge unit to provide protection to the dual-discharge unit against unintended damage from external forces, wherein the hood includes a left guard arranged along a left side of the dual-discharge unit, a right guard arranged along a right side of the dual-discharge unit and spaced apart from the left guard, and a top guard arranged over a top side of the dual-discharge unit to extend from the left guard to the right guard, wherein the left guard includes a first guard panel and a second guard panel spaced apart from the first guard panel such that a left shock-absorbing gap is formed between the first guard panel and the second guard panel.

2. The fluid-dispensing unit of claim 1, wherein the right guard includes a first guard panel and a second guard panel spaced apart from the first guard panel of the right guard such that a right shock-absorbing gap is formed between the first guard panel of the right guard and the second guard panel of the right guard.

3. The fluid-dispensing unit of claim 2, wherein the can lid is formed to include a drip unit coupled to the hood, the drip unit is arranged to extend downwardly from the fluid-discharge controller below the fluid-discharge controller and the dual-discharge unit so that the drip unit provides a flow path for fluid that may unintentionally leak out of the fluid-discharge controller rather than travel through the dual-discharge unit, the drip unit includes a left side support coupled to the second guard panel of the left guard, a right side support coupled to the second guard panel of the right guard, and a drip shield that extends between the left and right side supports at a right angle to the left and right side supports.

4. The fluid-dispensing unit of claim 1, wherein the can lid is formed to include a straw retainer spaced apart from the hood and configured to receive and retain the dual-discharge unit when the dual-discharge unit is in the first position so that the dual-discharge unit is secured in a fixed position adjacent to the fluid-storage can.

5. The fluid-dispensing unit of claim 1, wherein the shell further includes a shell top platform formed to include a platform top wall and an actuator aperture that receives the actuator and the hood is coupled to the shell top platform.

6. The fluid-dispensing unit of claim 5, wherein the top guard extends from the left guard to the right guard is coextensive with the platform top wall.

7. The fluid-dispensing unit of claim 1, wherein the dual-discharge unit includes a discharge connector formed to include a flow passageway that is inserted into a discharge orifice formed by the actuator, a swivel knuckle formed to include the spray path and the straw path and coupled to the discharge connector to pivot from the first position in which the spray path is in fluid connection with the flow passageway to the second position in which the straw path is in communication with the flow passageway, and a straw formed to include a straw passageway inserted into the straw path of the swivel knuckle so that the straw passageway is in fluid communication with the straw path and conducts the pressurized fluid from the swivel knuckle along the straw when the swivel knuckle is in the fourth position.

8. The fluid-dispensing unit of claim 7, wherein the can lid includes a straw retainer configured to receive and retain the straw when the swivel knuckle is in the third position so that the straw is secured in a fixed position relative to the fluid-storage can, the straw retainer includes a left retention nub and a right retention nub, and the left and right retention nubs are configured to mate with the straw in frictional engagement to secure the straw in a fixed position that is parallel and adjacent to the fluid-storage can when the swivel knuckle is in the third position.

9. A fluid-dispensing unit comprising a fluid-storage can including a container formed to include a fluid reservoir and a fluid discharger coupled to the container to communicate with the fluid reservoir in the container and allow pressurized fluid to exit the fluid-storage can, a fluid-discharge controller including a can lid mounted on the fluid-storage can and an actuator coupled to the can lid to move relative to the can lid from a discharge-blocking position arranged to prevent flow of pressurized fluid from the fluid reservoir to a discharge-allowing position arranged to allow flow of pressurized fluid from the fluid reservoir, and a dual-discharge unit formed to include a spray path and a straw path, the dual-discharge unit coupled to the fluid-discharge controller to move relative to the fluid-discharge controller between a first position arranged to direct the allowed flow of pressurized fluid from the fluid discharger through the spray path and a second position arranged to direct the allowed flow of pressurized fluid from the fluid discharger through the straw path, wherein the can lid is formed to include a drip unit that is arranged below the dual-discharge unit and below a discharge orifice when the fluid-storage can is arranged to extend downwardly from the fluid-discharge controller so that the drip unit provides a flow path for fluid that may unintentionally leak out of the fluid-discharge controller rather than travel through the dual-discharge unit, wherein the drip unit includes a left side support, a right side support spaced apart from the left side support, and a drip shield, the left and right side supports extend downward toward the container, and the drip shield extends between the left and right side supports at a right angle to the left and right side supports, wherein the drip shield has a curved shape and extends radially outward away from the fluid-storage can and downward toward the container to conduct fluid that may unintentionally leak out of the fluid-discharge controller away from the fluid-discharge controller and to block the fluid from pooling in an upwardly-extending brim included in the fluid-storage can.

10. The fluid-dispensing unit of claim 9, wherein the left side support includes a first curved back edge that extends radially outward away from the fluid-storage can and downward toward the container and a first straight front edge spaced apart from the first straight back edge, the right side support includes a second curved back edge that extends radially outward away from the fluid-storage can and downward toward the container and a second straight front edge spaced apart from the second curved back edge, the first curved back edge of the left side support is spaced apart from the second curved back edge of the right side support, and the drip shield extends between the first and second curved back edges.

* * * * *